US007331124B2

(12) United States Patent
Meschan

(10) Patent No.: US 7,331,124 B2
(45) Date of Patent: Feb. 19, 2008

(54) PLATE SUPPORT FOR ATHLETIC SHOE

(75) Inventor: David F. Meschan, Greensboro, NC (US)

(73) Assignee: AKEVA L.L.C., Greensboro, NC (US)

( * ) Notice: Subject to any disclaimer, the term of this patent is extended or adjusted under 35 U.S.C. 154(b) by 316 days.

(21) Appl. No.: 10/924,228

(22) Filed: Aug. 23, 2004

(65) Prior Publication Data

US 2005/0039347 A1 Feb. 24, 2005

Related U.S. Application Data

(60) Provisional application No. 60/497,228, filed on Aug. 22, 2003.

(51) Int. Cl.
*A43B 13/00* (2006.01)

(52) U.S. Cl. ..... 36/35 R; 36/27; 36/37; 36/28

(58) Field of Classification Search ..... 36/27–29, 36/35 R, 37, 35 B, 114
See application file for complete search history.

(56) References Cited

U.S. PATENT DOCUMENTS 2,174,752 A * 10/1939 Laursen ..... 36/35 R
5,224,277 A * 7/1993 Sang Do ..... 36/27
5,595,004 A * 1/1997 Lyden et al. ..... 36/29
5,598,645 A * 2/1997 Kaiser ..... 36/29
5,813,141 A * 9/1998 Cho ..... 36/29
5,842,291 A * 12/1998 Schmidt et al. ..... 36/29
5,901,467 A * 5/1999 Peterson et al. ..... 36/29
5,918,384 A 7/1999 Meschan
5,987,780 A * 11/1999 Lyden et al. ..... 36/29
6,026,593 A 2/2000 Harmon-Weiss et al.
6,253,466 B1 7/2001 Harmon-Weiss et al.
6,453,577 B1 * 9/2002 Litchfield et al. ..... 36/29
6,589,614 B2 * 7/2003 Stubblefield et al. ..... 428/34.1
6,694,642 B2 * 2/2004 Turner ..... 36/28
6,971,193 B1 * 12/2005 Potter et al. ..... 36/141
2003/0150133 A1 * 8/2003 Staffaroni et al. ..... 36/35 B

* cited by examiner

*Primary Examiner*—Marie Patterson
(74) *Attorney, Agent, or Firm*—Martin & Ferraro, LLP

(57) ABSTRACT

A plate support for supporting a wearer's foot. The heel support includes a flexible central plate joined at its periphery to one or more tubular portions. The heel support provides cushioning without the need for an air-tight enclosure in the rear sole of a shoe.

22 Claims, 10 Drawing Sheets

FIG. 6A
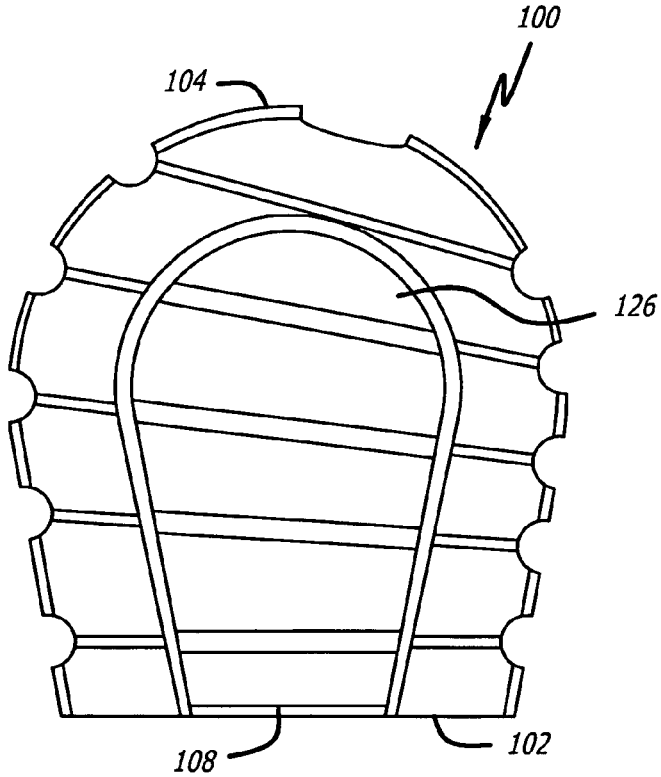
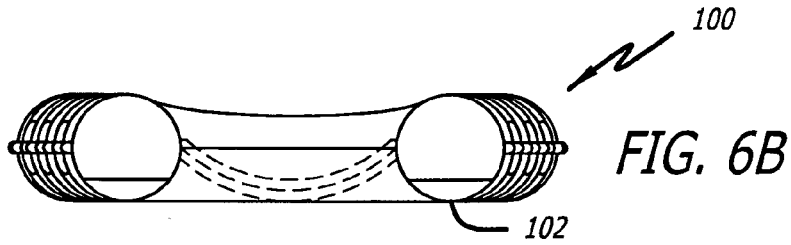
FIG. 6B
FIG. 6C
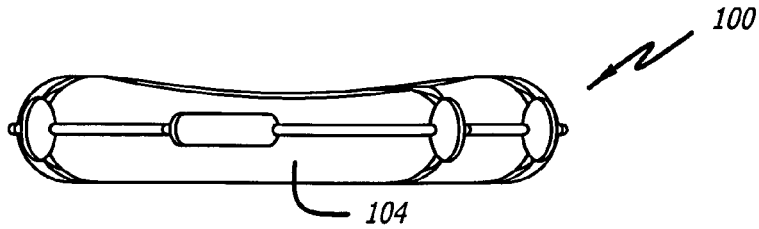
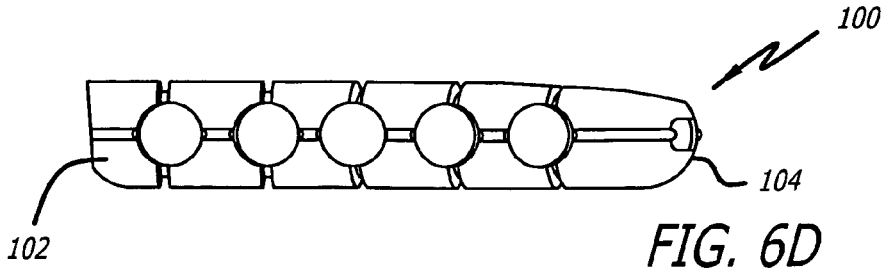
FIG. 6D

FIG. 7
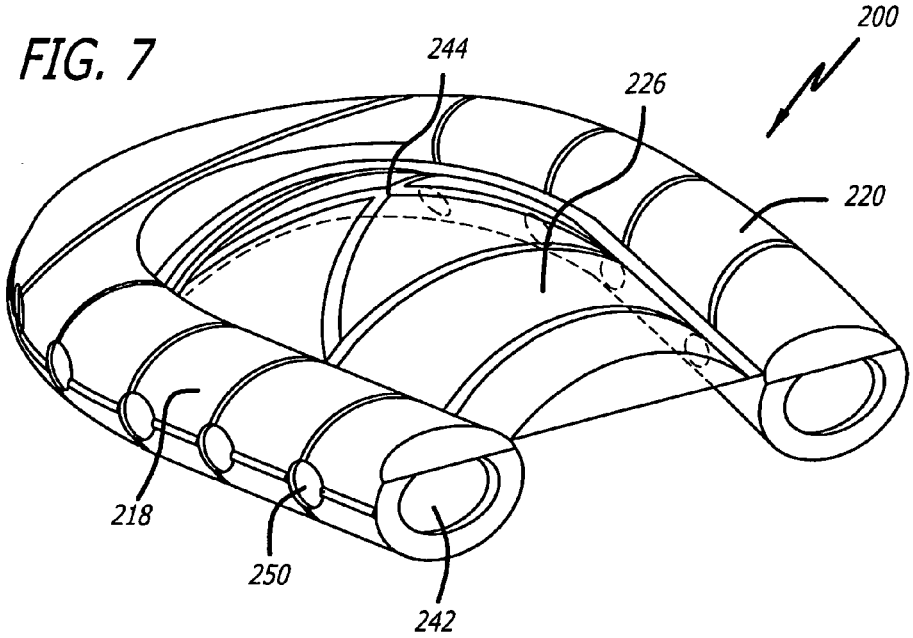
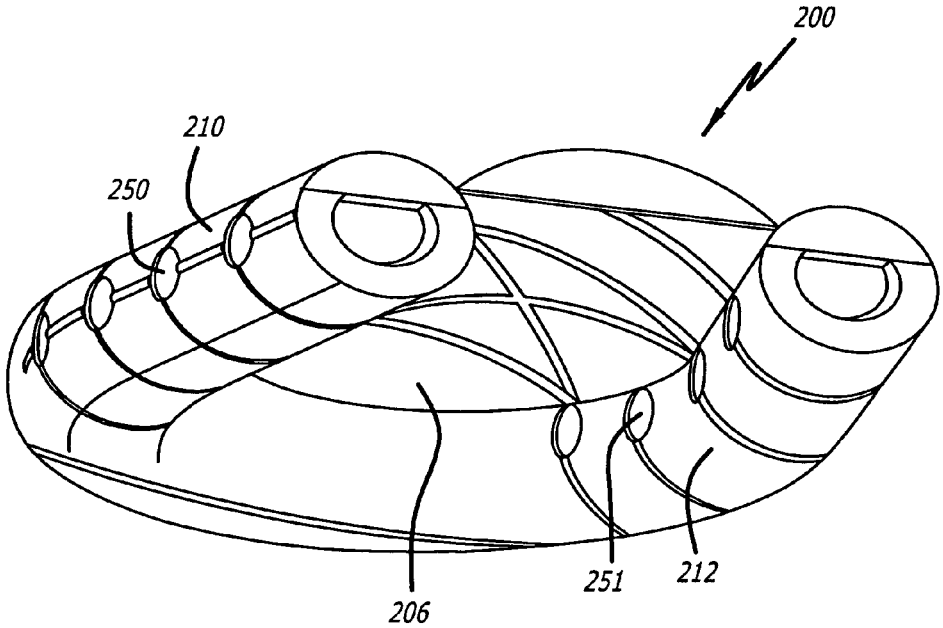
FIG. 8

FIG. 9A
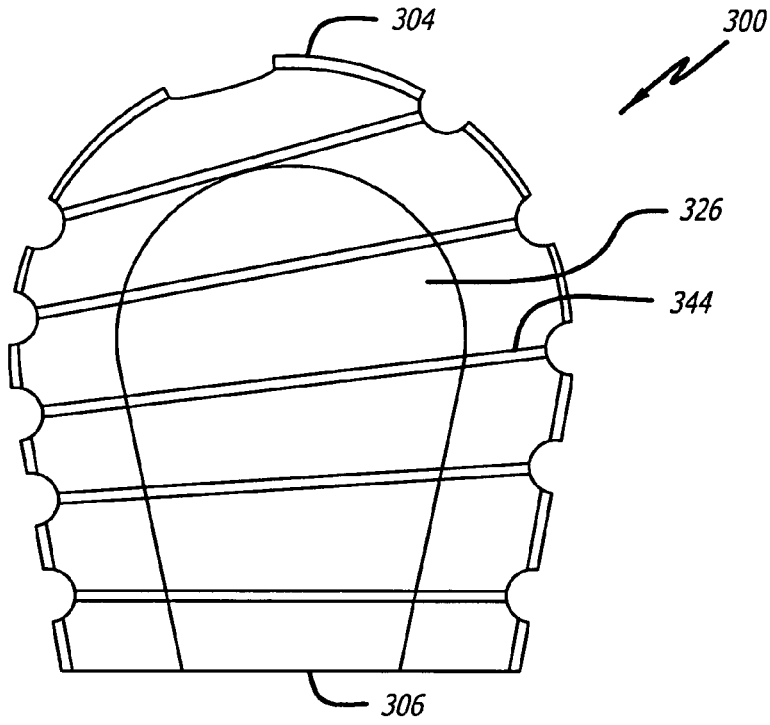
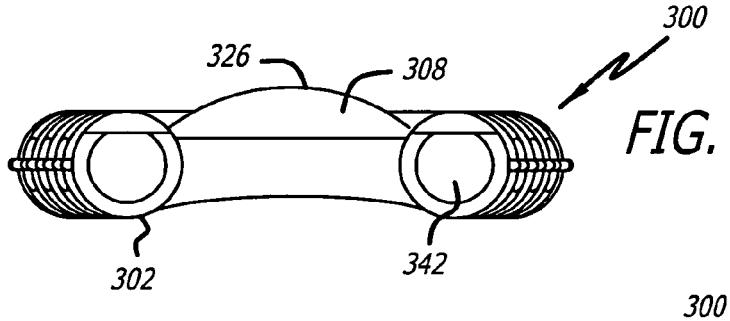
FIG. 9B
FIG. 9C
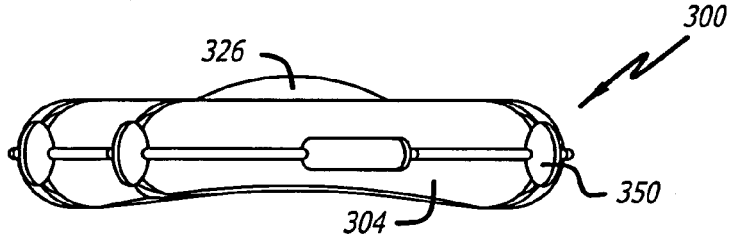
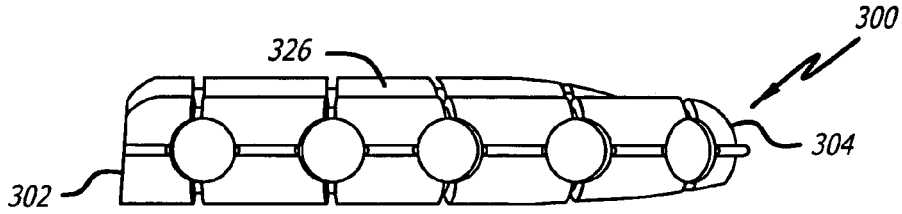
FIG. 9D

FIG. 10A
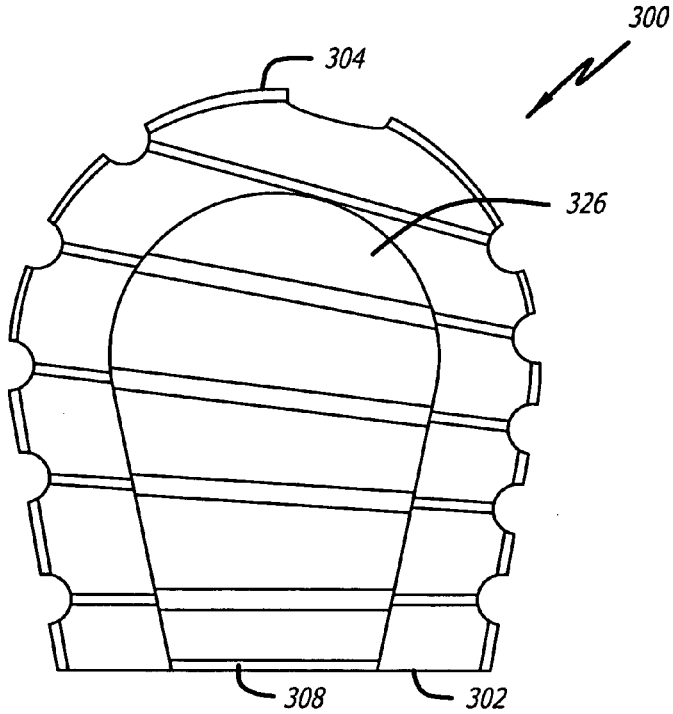
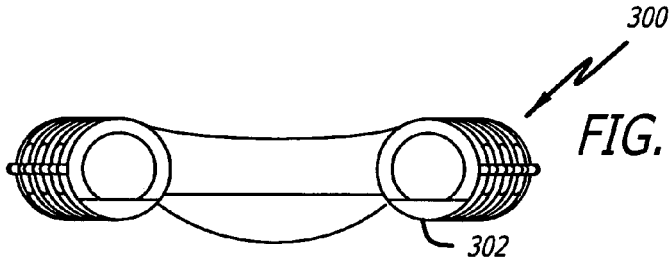
FIG. 10B
FIG. 10C
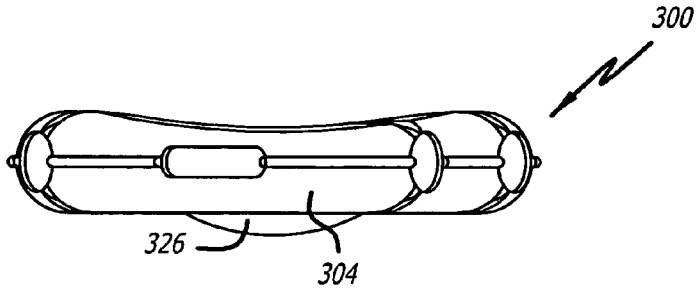
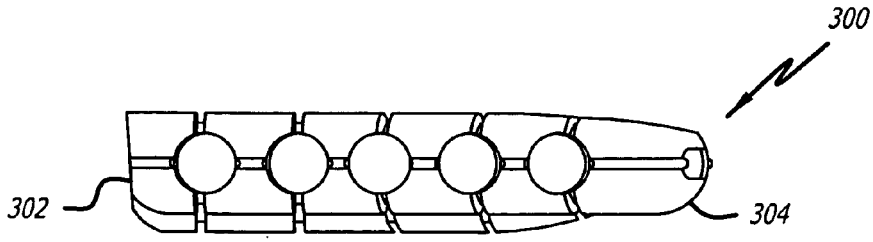
FIG. 10D

FIG. 12A
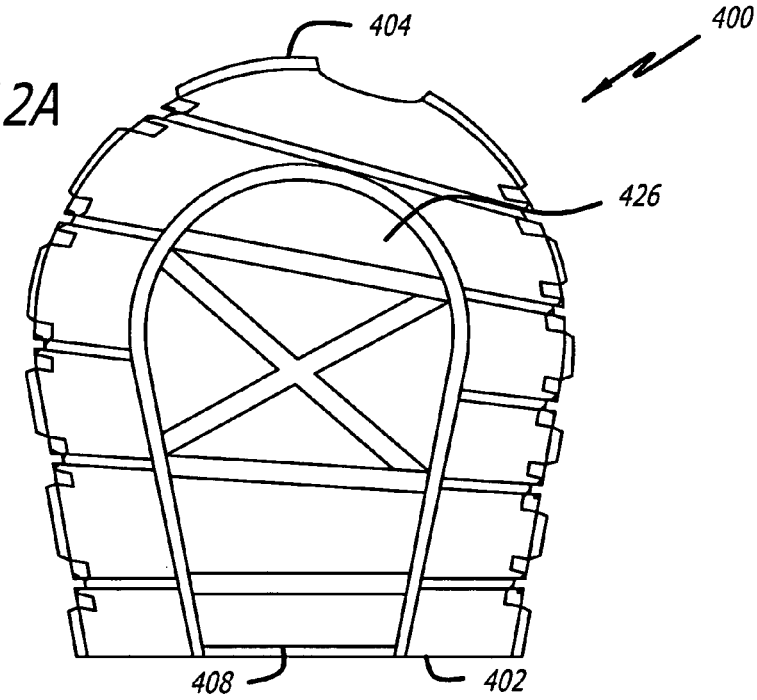
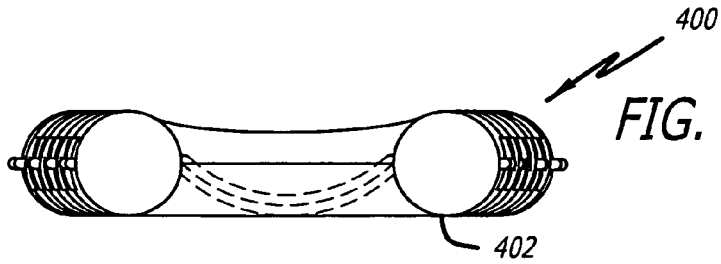
FIG. 12B
FIG. 12C
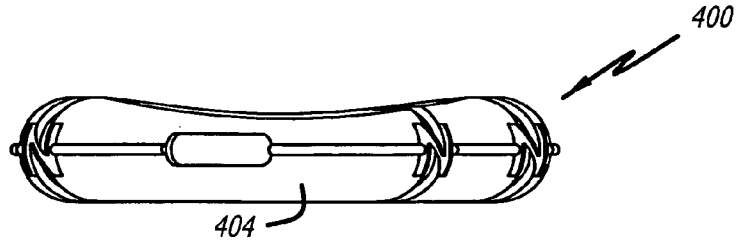
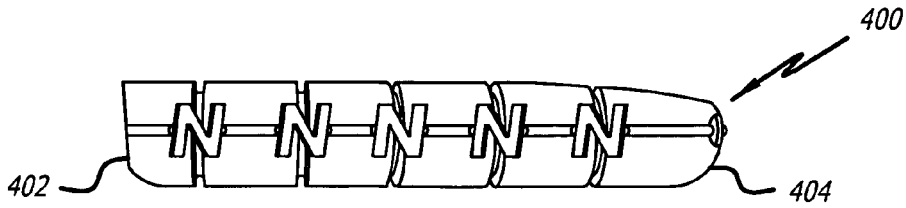
FIG. 12D

PLATE SUPPORT FOR ATHLETIC SHOE

The present application claims the benefit of Provisional Application No. 60/497,228, filed Aug. 22, 2003, the disclosure of which is incorporated herein by reference.

BACKGROUND OF THE INVENTION

1. Field of the Invention

The present invention relates to a cushion for placement in a shoe sole for cushioning and supporting a foot. More particularly, the invention relates to a plate support that has tubular portions disposed around a central portion for supporting a region of a foot.

2. Description of the Prior Art

FIG. 1 shows a sole employing a cushion 10 such as disclosed in U.S. Pat. No. 6,253,466, the disclosure of which in incorporated by reference herein. Cushion 10 is part of the midsole, but is partially exposed on its lower side and may contact the ground, thus serving also as an outsole.

The cushion has an outer tubular portion 24 that includes a medial tubular portion 18 and a lateral tubular portion 20, which are formed by resilient load-bearing tubular walls 19. Tubular portions 18 and 20 extend along medial and lateral edges of the foot shape of the sole. Tubular portions 18 and 20 extend generally along the medial and lateral edges of the heel shape part of the foot shape, in the heel region of the sole, opposite from each other with respect to the central portion 26. Tubular portions 18 and 20 also extend along the rear edge 22 of the heel shape, together forming the single, substantially continuous, outer tubular-portion 24. The resulting tubular portion 24 extends in a U-shape substantially continuously along the contour of the heel shape. Walls 19 forming the outer portion 24 are configured and dimensioned such that together with the main sole, walls 19 support edges of a foot and cushion impact produced thereon, for example, by walking, running, or jumping, without collapsing.

A hollow central portion 26 is disposed between and joined with the medial and lateral portions 18 and 20. Central portion 26 is formed by a resilient load-bearing central wall 28, which, as shown in FIG. 2, includes upper and lower wall portions. Central wall 28 is joined to the tubular walls 19 along a portion of its boundary 21, along the entire extent at which central portion 26 lies adjacent tubular portion 24, including on the medial, lateral, and rear sides of central portion 26. Bend sections 23 of the tubular portions 18 and 20 are bent along boundary 21 and have ends facing each other, which are connected. As seen in FIG. 1, bend sections 23 follow the shape of the boundary 21. Central wall 28 is configured and dimensioned for supporting and cushioning a central portion of the foot, in this case of the heel region of the foot, together with the main sole portion, without collapsing.

Cushion 10 also has recessed portions 30 that extend between the central and tubular portions 26 and 24. Recessed portions 30 join the central and tubular portions 26 and 24 while isolating vertical deformation between the sections of tubular walls 19 and central wall 28 that lie adjacent recessed portions 30.

As seen in FIG. 2, tubular walls 19 have vertically spaced elevated sections 32, and central wall has vertically spaced elevated sections 34. Because elevated portions 32 of tubular walls 19 are isolated from elevated portions 34 of central wall 28, substantially no vertical compression is transmitted therebetween across recessed portions 30.

Referring again to FIG. 1, cushion 10 also includes a coupling portion 36 with at least one wall elevated from the level of recessed portions 30, separating recessed portions 30 of cushion 10. Coupling wall 36 connects central elevated sections 34 to tubular elevated sections 32. This connection couples the adjacent elevated sections 32 and 34 such that vertical deformation is transmitted between tubular walls 19 and central wall 28.

Coupling portion 36 permits energy to be stored, absorbed, and returned to the foot by both central walls 28 and tubular walls 18 and 20 when cushion 10 is impacted in locations on either the central or tubular portions 26, 18, or 20 that are near coupling portion 36. Coupling portion 36 is disposed at the rear of the heel, generally aligned with a heel strike area 52.

It is well known in the art that during a step, particularly while a wearer is running, the wearer's foot strikes the sole generally along a strike path 66, shown in FIG. 1. The strike path 66 along the sole extends from the heel to the fore foot portion of the sole. This path 66 receives first and largest loads from impact on the sole.

The cushion is shown in FIG. 1 is disposed in the sole such that the heel strike area is disposed in the region defined behind lines 54 and 56. If cushion 10 is sized for a men's size 9.5 shoe, lines 54 and 56 intersect centerline 38 of cushion 10 at about 23 to 31 mm from the rear of cushion 10. Line 54 extends laterally at an angle 58 of about 25 degrees forward from a horizontal line 60 normal to the centerline 38. Line 56 extends medially at an angle 62 of about 5 degrees behind line 60. Thus, the coupling portion 36, being disposed generally centrally with respect to the heel strike area 52, is displaced laterally from the centerline 38.

Because central and tubular portions 26 and 24 are hollow, central portion 26 defines a central interior chamber 40, and tubular portion 24 defines a tubular interior chamber 42. Central interior chamber 40 extends substantially across the middle of the cushion. Central and tubular chambers 40 and 42 are communicated through the interior of coupling portion 36. Tubular and central walls 19 and 28 are coupled for transmitting vertical deformation therebetween where coupling portion 36 communicates interior chambers 40 and 42.

Central and tubular walls 28 and 19 also have stiffening ribs 44 that extend widthwise across central and tubular portions 26 and 24. As walls 19 and 28 of cushion 10 are of substantially uniform thickness, ribs 44 form grooves 46 on an opposite side of walls 19 and 28 therefrom. Ribs 44 increase the bending stiffness of walls 19 and 28.

As shown in FIG. 1, the bottom central wall 28 preferably includes an indented portion 64 that has substantially the same depth as ribs 44. Indented portion 64 may display decorative or trade insignia.

The cross-sectional shape of cushion 10 taken along plane II-II of FIG. 1, which extends widthwise and vertically through cushion 10, is best shown in FIG. 2. Both central and tubular walls 28 and 19 have an arcuate shape. Central wall 28 defines an oval cross-section.

The cross-sections of tubular walls 19 are generally circular when compared to the cross-section of central wall 28. Due to these shapes, cushion 10 stores and returns energy to a wearer. The relatively wide and horizontal elevated portions 34 of central walls 28 renders the central portion less stiff than tubular portion 24. At the widest part of the cushion 10, which is shaped for a heel, central portion 26 reaches a maximum width 74 that is greater than about 50% of the maximum width 84 of cushion 10 from the medial edge of the medial tubular portion 18 to the lateral edge of the lateral tubular portion 20. One of the medial and lateral tubular portions 18 and 20 is at least about 15% as wide as central portion 26 where cushion 10 is widest. Central and tubular portions 26 and 24 have substantially the same vertical height 72.

While the cushion described above exhibits satisfactory shock absorbing characteristics, there exists a need for an improved cushion that provides comparable to superior shock absorbing qualities at a reduced weight.

SUMMARY OF THE INVENTION

In one preferred embodiment of the present invention a plate support for use in a shoe is provided. The plate support includes first and second tubular portions having resilient load-bearing first and second hollow tubular walls, respectively. One of the walls has a shape for extending generally along a lateral side of a wearer's foot and the other of the walls has a shape for extending generally along a medial side of the wearer's foot. The tubular walls have a thickness, material, and shape providing sufficient strength for supporting and cushioning the lateral and medial sides of the wearer's foot. The tubular walls have an exterior surface with an outwardly oriented portion and an inwardly oriented portion, the inwardly oriented portion of the first and second tubular walls being oriented toward one another. The plate support further includes a central portion having a resilient load-bearing central surface disposed between and joined with the first and second tubular portions. The central portion has a strength for supporting and cushioning a width-wise central part of the foot. The central portion does not form a portion of an air-tight enclosure.

In another preferred embodiment of the present invention, the outwardly oriented portion of at least one of the first and second tubular walls includes at least one hole therethrough.

In another preferred embodiment of the present invention, the inwardly oriented portion of at least one of the first and second tubular walls includes at least one hole therethrough.

The present invention provides for one or more of the following advantages. The over-all weight of the shoe is reduced as a result of a reduction in the amount of material used to make the plate support. The cushioning properties are enhanced without the need for trapped air. The costs of manufacturing are reduced in part due to the reduction of materials required to construct the plate support as well as the substantial reduction or elimination of any need for the incorporation of air-tight enclosures containing trapped air or other shock-absorbing substances in the rear sole of the shoe. These and other advantages of the present invention will be apparent from review of the following specification and the accompanying drawings.

BRIEF DESCRIPTION OF THE DRAWINGS

FIG. 6A is a bottom view of the plate support of FIG. 3.

FIG. 6B is a front elevation view of the plate support of FIG. 3 rotated 180 degrees about its axis.

FIG. 6C is a rear elevation view of the plate support of FIG. 3 rotated 180 degrees about its axis.

FIG. 6D is a side elevation view of the plate support of FIG. 3 rotated 180 degrees about its axis.

FIG. 7 is a top perspective view of a plate support in accordance with another preferred embodiment of the present invention.

FIG. 8 is a bottom perspective view of the plate support of FIG. 7.

FIG. 9A is a top plan view of a plate support in accordance with a further preferred embodiment of the present invention.

FIG. 9B is a front elevation view of the plate support of FIG. 9A.

FIG. 9C is a rear elevation view of the plate support of FIG. 9A.

FIG. 9D is a side elevation view of the plate support of FIG. 9A.

FIG. 10A is a bottom plan view of the plate support of FIG. 9A.

FIG. 10B is a front elevation view of the plate support of FIG. 9A rotated 180 degrees about its axis.

FIG. 10C is a rear elevation view of the plate support of FIG. 9A rotated 180 degrees about its axis.

FIG. 10D is a side elevation view of the plate support of FIG. 9A rotated 180 degrees about its axis.

FIG. 12A is a bottom plan view of the plate support of FIG. 11A.

FIG. 12B is a front elevation view of the plate support of FIG. 11A rotated 180 degrees about its axis.

FIG. 12C is a rear elevation view of the plate support of FIG. 11A rotated 180 degrees about is axis.

FIG. 12D is a side elevation view of the plate support of FIG. 11A rotated 180 degrees about its axis.

DETAILED DESCRIPTION OF THE PREFERRED EMBODIMENT

Figure 1:
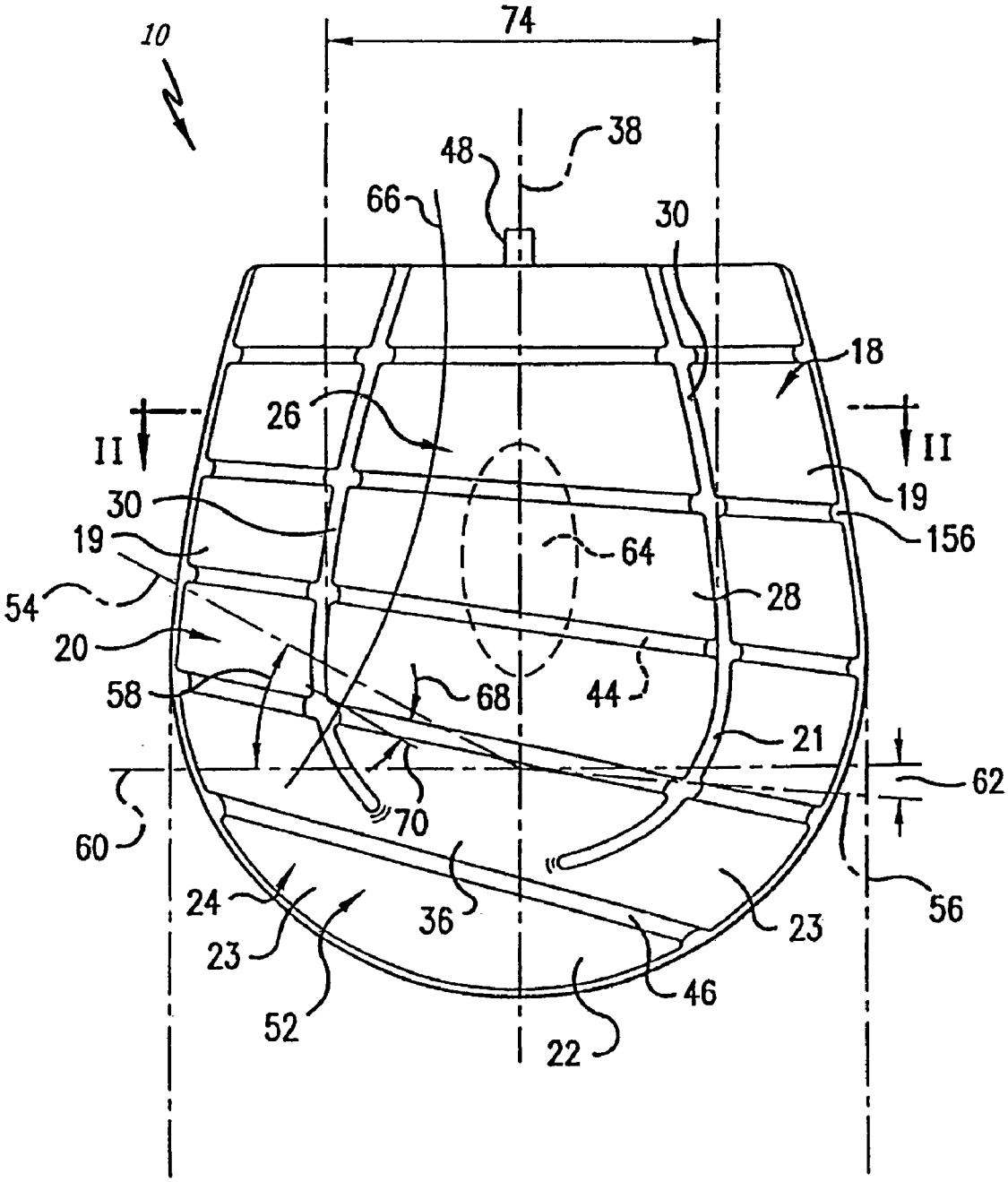
FIG. 1 PRIOR ART
FIG. 1 is a top plan view of a cushion of the prior art.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims. Wherever possible, the same reference numbers will be used throughout the drawings to refer to the same or like parts.

FIGS. 3 to 6D show a preferred embodiment of a plate support 100 in accordance with the present invention. Plate support 100 includes a front 102, a rear 104, a first tubular portion 118, a second tubular portion 120, and a central portion 126 having a central wall 128 between first and second tubular portions 118, 120. Central portion 126 is preferably a flexible plate that is capable of deflecting vertically relative to first and second tubular portions 118, 120. Examples of flexible plates suitable for footwear are taught by Meschan in U.S. Pat. Nos. 5,615,497; 5,560,126; 5,918,384; and 5,806,210, the disclosures of which are incorporated herein by reference.

Central portion 126 has an upper surface that is preferably convex and a lower surface 106 that is preferably concave. In a preferred embodiment, central portion 126 resembles a clamshell and functions similar to a trampoline to provide shock absorbing qualities to the shoe. The front of central portion 126 includes a wall 108 that provides additional stability to central portion 126. It will be appreciated that central portion 126 may still provide sufficient shock absorbing qualities without the presence of wall 108. Additionally, it will be appreciated that central plate wall 128 may be flat or contain an indentation or central concave portion, such as shown in FIG. 18 of U.S. Pat. No. 5,918,384, to guide a wearer's heel during downward movement of central portion 126.

The top of plate support 100 preferably includes a plurality of stiffening ribs 144 arranged generally parallel to one another and extending from side to side along the width of the support plate. Preferably ribs 144 extend across the entire width of central portion 126 and around substantially the entire exterior surface of each tubular portion.

Figure 2:
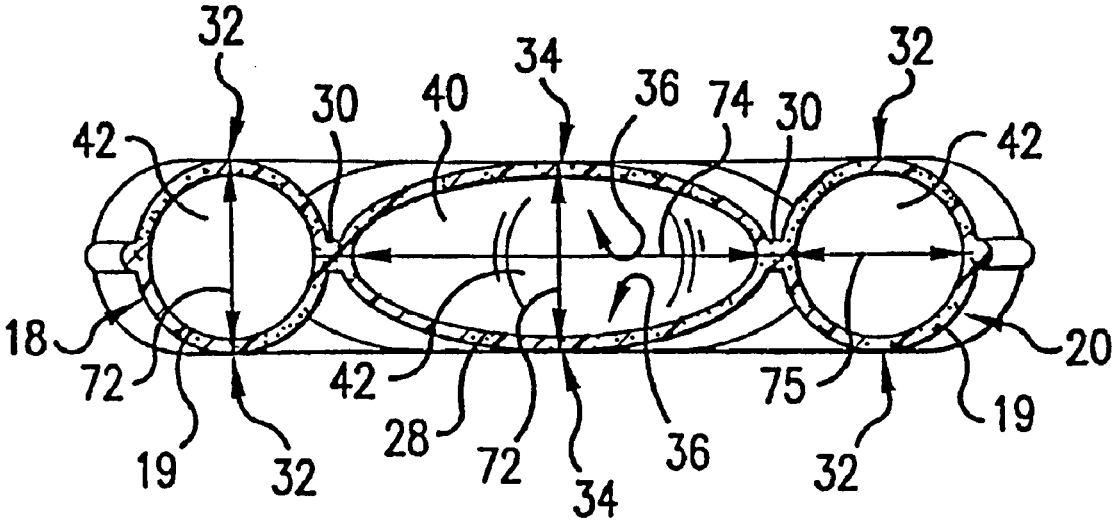
FIG.2 PRIOR ART
FIG. 2 is a cross-sectional front view of the cushion of FIG. 1 along plane II-II of FIG. 1.
Figure 3:
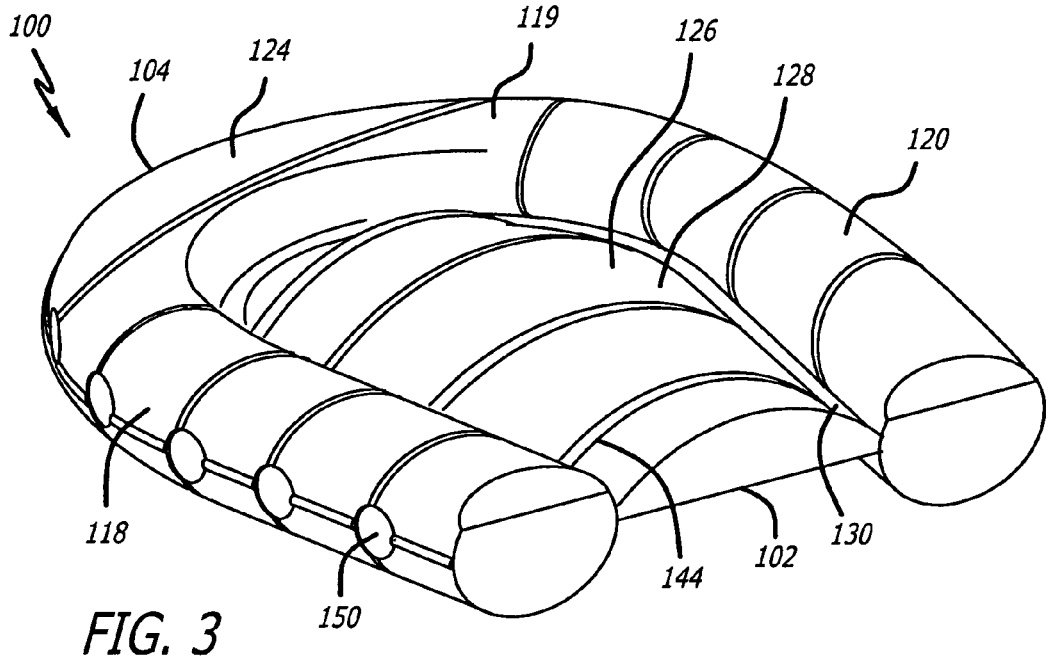
FIG. 3 is a top perspective view of a plate support in accordance with a preferred embodiment of the present invention.
Figure 4:
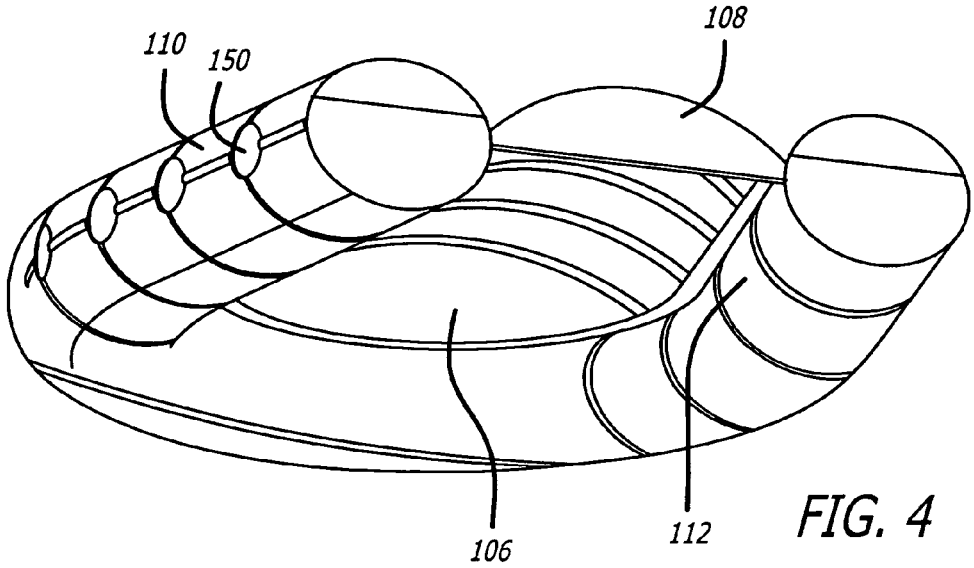
FIG. 4 is a bottom perspective view of the plate support of FIG. 3.

First and second tubular portions 118, 120 each include a circumferential wall 124 and have an outwardly oriented portion 110 and an inwardly oriented portion 112. As shown in FIG. 2, the inwardly oriented portions of first and second tubular portions 118, 120 are preferably oriented toward one another. First and second tubular portions 118, 120 are preferably hollow. It will be appreciated that the cross section of outer tubular portions 118, 120 may take a variety of shapes without deviating from the scope of the present invention. For example, first and second outer tubular portions may be circular or oval-shaped.

Outwardly oriented portion 110 of each tubular portion includes at least one opening 150 therethrough leading to the hollow interior of each tubular portion. Preferably, openings 150 are positioned to intersect with ribs 144 to produce maximum cushioning. The cushioning may be adjusted by positioning one or more of openings 150 to be off-set from the ribs.

Figure 5A:
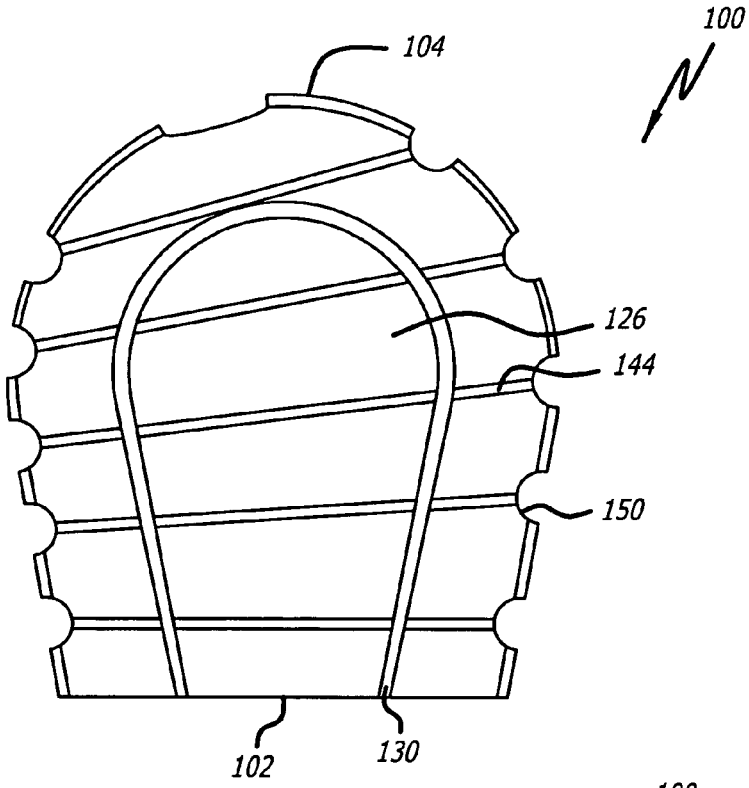
FIG. 5A is a top plan view of the plate support of FIG. 3.
Figure 5B:
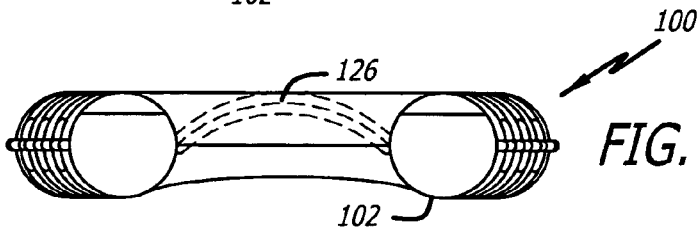
FIG. 5B is a front elevation view of the plate support of FIG. 3.
Figure 5C:
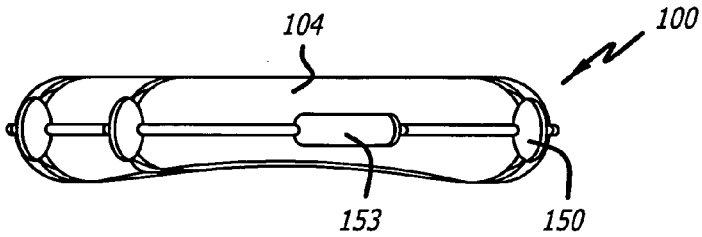
FIG. 5C is a rear elevation view of the plate support of FIG. 3.
Figure 5D:
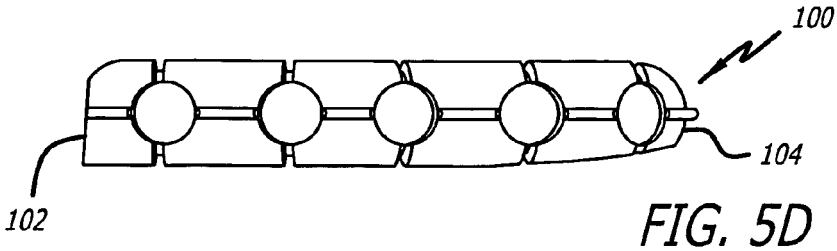
FIG. 5D is a side elevation view of the plate support of FIG. 3.
Figure 11A:
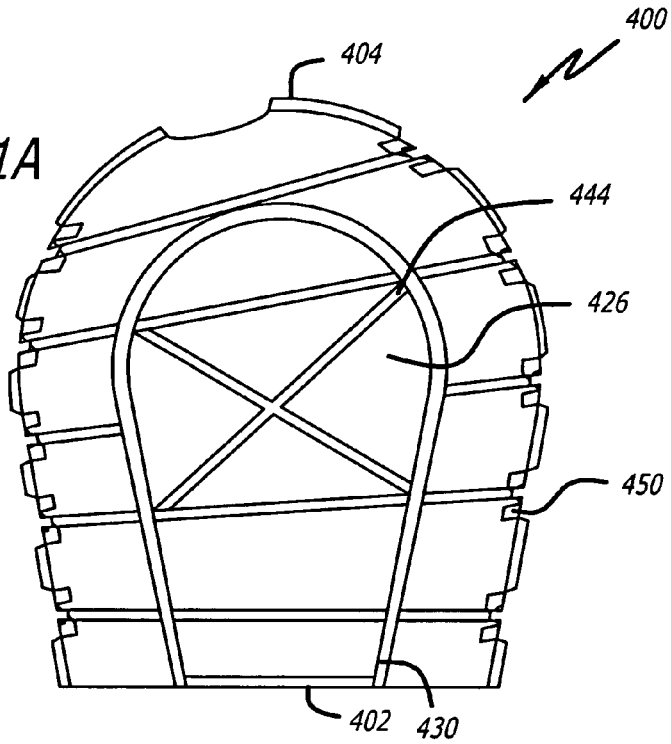
FIG. 11A is a top plan view of a plate support in accordance with an additional preferred embodiment of the present invention.
Figure 11B:
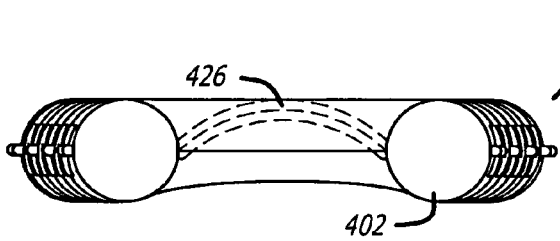
FIG. 11B is a front elevation view of the plate support of FIG. 11A.
Figure 11C:
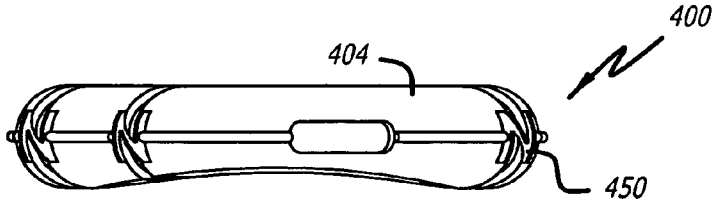
FIG. 11C is a rear elevation view of the plate support of FIG. 11A.
Figure 11D:
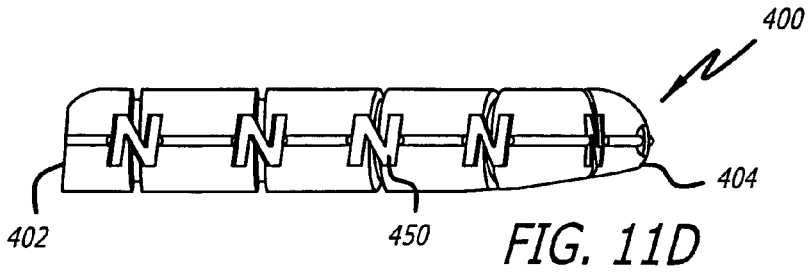
FIG. 11D is a side elevation view of the plate support of FIG. 11A.

Openings 150 may be circular, elliptical, or any shape that is suitable for the intended purpose. For example, as shown in FIG. 5C, opening 153 in rear end 102 is generally elliptical to correspond to the reduced height at rear end 102 of plate support 100. Additionally, through-openings may be included in central portion 126, similar to those shown in FIG. 28 of U.S. Pat. No. 5,560,126. The size of the openings may be uniform or may vary depending upon the location of the openings. Including a plurality of openings provides the advantages of reducing overall weight, enhancing springiness, and reducing material costs.

In FIGS. 7 and 8, another preferred embodiment of the plate support of the present invention is shown and generally referred to by the reference number 200. Plate support 200 is similar to plate support 100, but the region of intersection between central portion 226 and first and second tubular portions 218, 220 is more elevated relative to a mid-horizontal plane of plate support 200. Preferably, the region of intersection between central portion 226 and first and second portions 218, 220 is in the upper one-third of the maximum height of the outer tubular portions.

As shown in FIG. 8, the elevated height of central portion 226 allows for the provision of one or more openings 251 in inwardly oriented portions 212 of first and second tubular portions 218, 220 that lead to hollow interior 242. Openings 251 may be oriented such that they align with openings 250 of outwardly oriented portions 210. Alternatively, openings 251 may be off-set from openings 250. As will be appreciated, the shape, number, and placement of the openings may be varied while still being within the scope of the present invention. Further, instead of a hollow interior connecting a plurality of openings, first and second tubular portions may include a plurality of channels between the outwardly oriented portion and inwardly oriented portion, each channel connecting one of openings 250 and 251.

As shown in FIGS. 7 and 8, ribs 244 are preferably arranged to intersect below the approximate center of the calcaneus of the wearer to provide increased stability and/or springiness where it is most needed. It will be appreciated that the ribs may intersect at other locations as well. Further, the angle of intersection between the intersecting ribs may varied without departing from the scope of the present invention. A network of intersecting ribs may be provided, or a pattern of intersecting ribs interspaced with non-intersecting ribs. The ribs themselves can vary in thickness and cross-sectional shape. For example, the cross-sectional shape of the ribs may include an arcuate shape or triangular shape. The rib thickness may vary across the width and/or from rib to rib along the length of the plate support.

In FIGS. 9A to 10D, another preferred embodiment of the plate support of the present invention is shown and generally referred to by the reference number 300. Plate support 300 is similar to plate support 200, but ribs 344 are generally parallel to one another.

In FIGS. 11A to 12D, another preferred embodiment of the plate support of the present invention is shown and generally referred to by the reference number 400. Plate support 400 is similar to plate support 100, but at least two ribs 444 intersect one another in a manner such as described above in relation to plate support 200. Further, openings 450 are stylized with an "N" shape. It will be appreciated that the openings may have other shapes corresponding to a different logo if so desired.

The plate support of the present invention may be made from a conventional Pebax polymer, including the hardest Pebax material available from ATOFINA. The thickness of the plate support is preferably sufficiently thin so as to be light-weight while still retaining its springiness. It will be appreciated that the plate support may include more than one material. For example, the central portion may include Pebax while the outer tubular portions may include a rubber material. Pebax is advantageous for its characteristics of resiliency and durability. A plate support made from a Pebax material may be made thinner, and thus weigh less than conventional support cushions made from materials such as Hytrel.

The plate support of the present invention may be integrally formed, or may be modular and glued or otherwise attached together. Two examples of integrally forming the plate support include injection-molding and blow-molding. The plate support may also be formed integrally with an arch bridge (not shown) for further stability. The plate support may be configured to be removable and replaceable so that the wear characteristics of the wearer may be better fulfilled. The plate support may include vertically extending walls around its periphery or around the periphery of the central portion to provide lateral stability to the heel of a wearer.

It is preferred that the central portion not form a part of an air-tight enclosure. This permits the central plate to flex more easily utilizing the natural springiness of the plate material and rib configuration (if any), and substantially reduces the need for trapped air or other shock absorbing substances in the rear sole of the shoe. However, it will be appreciated that the outer tubular portions may be configured without openings to form an air-tight enclosure containing trapped air, gel, or another conventional shock absorbing substance instead of having a hollow interior in air communication with the exterior of the shoe.

There is disclosed in the above description and the drawings plate supports which fully and effectively accomplish the objectives of this invention. However, it will be apparent that variations and modifications of the disclosed embodiments may be made without departing from the principles of the invention.

I claim:

1. A component for use in a shoe, the component comprising:

first and second tubular portions having resilient load-bearing first and second hollow tubular walls, respectively, one of the walls having a shape for extending generally along a lateral side of a wearer's foot and the other having a shape for extending generally along a medial side of the wearer's foot, the tubular walls having a thickness, material, and shape providing sufficient strength for supporting and cushioning the lateral and medial sides of the wearer's foot, the tubular walls having an exterior surface with an outwardly oriented portion and an inwardly oriented portion, the inwardly oriented portion of the first and second tubular walls being oriented toward one another; and a central portion having a resilient load-bearing central surface disposed between and joined with the first and second tubular portions, the central portion having a strength for supporting and cushioning a width-wise central part of the foot, the central portion not forming a portion of an air-tight enclosure, the central portion having a top having a plurality of ribs.

2. The component of claim 1, wherein at least two of the ribs intersect one another.

3. The component of claim 1, wherein the component is made from plastic.

4. The component of claim 1, wherein the outwardly oriented portion of at least one of the first and second tubular walls includes at least one hole therethrough.

5. The component of claim 4, wherein the inwardly oriented portion of at least one of the first and second tubular walls includes at least one hole therethrough, the holes of the outwardly oriented portion and the inwardly oriented portion being in communication with one another.

6. The component of claim of claim 1, wherein the inwardly oriented portion of at least one of the first and second tubular walls includes at least one hole therethrough.

7. The component of claim 1, wherein the first and second tubular portions and the central portion are integrally formed.

8. The component of claim 1, wherein the component is located at least in part beneath the calcaneous of the wearer's foot.

9. A component for use in a shoe, the plate component comprising:

first and second tubular portions having resilient load-bearing first and second hollow tubular walls, respectively, one of the walls having a shape for extending generally along a lateral side of a wearer's foot and the other having a shape for extending generally along a medial side of the wearer's foot, the tubular walls having a thickness, material, and shape providing sufficient strength for supporting and cushioning the lateral and medial sides of the wearer's foot, the tubular walls having an exterior surface with an outwardly oriented portion and an inwardly oriented portion, the inwardly oriented portion of the first and second tubular walls being oriented toward one another, the outwardly oriented portion of at least one of the first and second tubular walls including at least one hole therethrough; and a central portion having a resilient load-bearing central surface disposed between and joined with the first and second tubular portions, the central portion having a strength for supporting and cushioning a width-wise central part of the foot, the central portion having a lower surface between the first and second tubular portions, the central portion having a top having a plurality of ribs.

10. The component of claim 9, wherein at least two of the ribs intersect one another.

11. The component of claim 9, wherein the component is made fromplastic.

12. The component of claim 9, wherein the inwardly oriented portion of at least one of the first and second tubular walls includes at least one hole therethrough.

13. The component of claim 12, wherein the holes of the outwardly oriented portion and the inwardly oriented portion are in communication with one another.

14. The component of claim 9, wherein the first and second tubular portions and the central portion are integrally formed.

15. The component of claim 9, wherein the component is located at least in part beneath the calcaneous of the wearer's foot.

16. A component for use in a shoe, the component comprising:

first and second tubular portions having resilient load-bearing first and second hollow tubular walls, respectively, one of the walls having a shape for extending generally along a lateral side of a wearer's foot and the other having a shape for extending generally along a medial side of the wearer's foot, the tubular walls having a thickness, material, and shape providing sufficient strength for supporting and cushioning the lateral and medial sides of the wearer's foot, the tubular walls having an exterior surface with an outwardly oriented portion and an inwardly oriented portion, the inwardly oriented portion of the first and second tubular walls being oriented toward one another, the inwardly oriented portion of at least one of the first and second tubular walls including at least one hole therethrough, the first and second tubular portions have a top, a bottom, and a maximum height therebetween; and a central portion having a resilient load-bearing central surface disposed between and joined with the first and second tubular portions, the central portion having a strength for supporting and cushioning a width-wise central part of the foot, the central portion having a lower surface between the first and second tubular portions, the central portion being connected to the first and second portions at a position closer to the top of the first and second tubular portions than the bottom of the first and second tubular portions, the central portion having a top having a plurality of ribs.

17. The component of claim 16, wherein at least two of the ribs intersect one another.

18. The component of claim 16, wherein the component is made fromplastic.

19. The component of claim 16, wherein the first and second tubular portions and the central portion are integrally formed.

20. The component of claim 16, wherein the central portion includes at least one hole therethrough.

21. The component of claim 16, wherein the lower surface of the central portion is substantially concave.

22. The component of claim 16, wherein the component is located at least in part beneath the calcaneous of the wearer's foot.

* * * * *

UNITED STATES PATENT AND TRADEMARK OFFICE

CERTIFICATE OF CORRECTION

PATENT NO. : 7,331,124 B2
APPLICATION NO. : 10/924228
DATED : February 19, 2008
INVENTOR(S) : David F. Meschan It is certified that error appears in the above-identified patent and that said Letters Patent is hereby corrected as shown below:

Column 7:
Line 42: change “of claim of claim” to -- of claim --;
Line 51: delete “plate.”.

Column 8:
Line 10: change “fromplastic” to -- from plastic --; and
Line 56: change “fromplastic” to -- from plastic --.

Signed and Sealed this
Twenty-second Day of February, 2011

David J. Kappos

David J. Kappos
*Director of the United States Patent and Trademark Office*